US005273274A

United States Patent [19]

Thomson et al.

[11] Patent Number: 5,273,274

[45] Date of Patent: Dec. 28, 1993

[54] SHEET FEEDING SYSTEM WITH LATERAL REGISTRATION AND METHOD FOR REGISTERING SHEETS

[75] Inventors: Michael B. Thomson, Ware; Paul Theobald, Leighton Buzzard, both of United Kingdom

[73] Assignee: Xerox Corporation, Rochester, N.Y.

[21] Appl. No.: 940,933

[22] Filed: Sep. 4, 1992

[51] Int. Cl.[5] ..... B65H 7/02

[52] U.S. Cl. ..... 271/228

[58] Field of Search ..... 271/227, 228, 248, 249, 271/252, 272, 225

[56] References Cited

U.S. PATENT DOCUMENTS

| | | | |
|---|---|---|---|
| 4,058,359 | 11/1977 | Urselmann | 355/109 |
| 4,480,825 | 11/1984 | Landa | 271/81 |
| 4,613,125 | 5/1986 | Jeschke | 271/227 |
| 4,712,786 | 12/1987 | Looney | 271/207 |
| 4,799,084 | 1/1989 | Koike et al. | 355/14 SH |
| 4,805,892 | 2/1989 | Calhoun | 271/225 |
| 4,823,159 | 4/1989 | Yamamoto et al. | 355/3 SH |
| 4,916,493 | 4/1990 | DeVito | 355/321 |
| 5,049,948 | 9/1991 | Brown et al. | 355/319 |
| 5,094,442 | 3/1992 | Kamprath et al. | 271/227 |
| 5,152,511 | 10/1992 | Shido et al. | 270/53 |
| 5,174,560 | 12/1992 | Fujii | 271/227 X |
| 5,219,159 | 6/1993 | Malachowski et al. | 271/228 |

FOREIGN PATENT DOCUMENTS

| | | | |
|---|---|---|---|
| 147747 | 6/1988 | Japan | 271/227 |
| 81741 | 3/1989 | Japan | 271/228 |
| 198952 | 8/1990 | Japan | 271/228 |
| 49145 | 2/1992 | Japan | 271/228 |

*Primary Examiner*—D. Glenn Dayoan
*Assistant Examiner*—Boris Milef

[57] ABSTRACT

A sheet feeding and lateral registration system, including feed rollers (41, 42) for feeding sheets (50) in a process direction and registration apparatus (52, 53) for registering each sheet in a direction laterally of the process direction. The registration apparatus includes a shifting system (53) for laterally shifting a carriage (52) on which the feed rollers are mounted. A single edge sensor (57) is arranged to provide a signal on detecting the presence of a sheet, and a control controls the lateral shifting system in response to that signal. The control is operated such that if the sheet (50) is not detected by the sensor (57) on initial entry of the sheet into the feed rollers, then the shifting system (53) is activated to move the feed rollers laterally towards the sensor until the sheet is detected by the sensor, whereupon the lateral movement is stopped. However, if the sheet is detected by that sensor on initial entry of the sheet into the system, then the shifting system is first activated to move the feed rollers laterally away from the sensor until the sensor no longer detects the sheet, and then the shifting system is reverse activated to laterally move the feed rollers back towards the sensor until the sheet is again detected by the sensor.

5 Claims, 2 Drawing Sheets

SHEET FEEDING SYSTEM WITH LATERAL REGISTRATION AND METHOD FOR REGISTERING SHEETS

Figure 1:
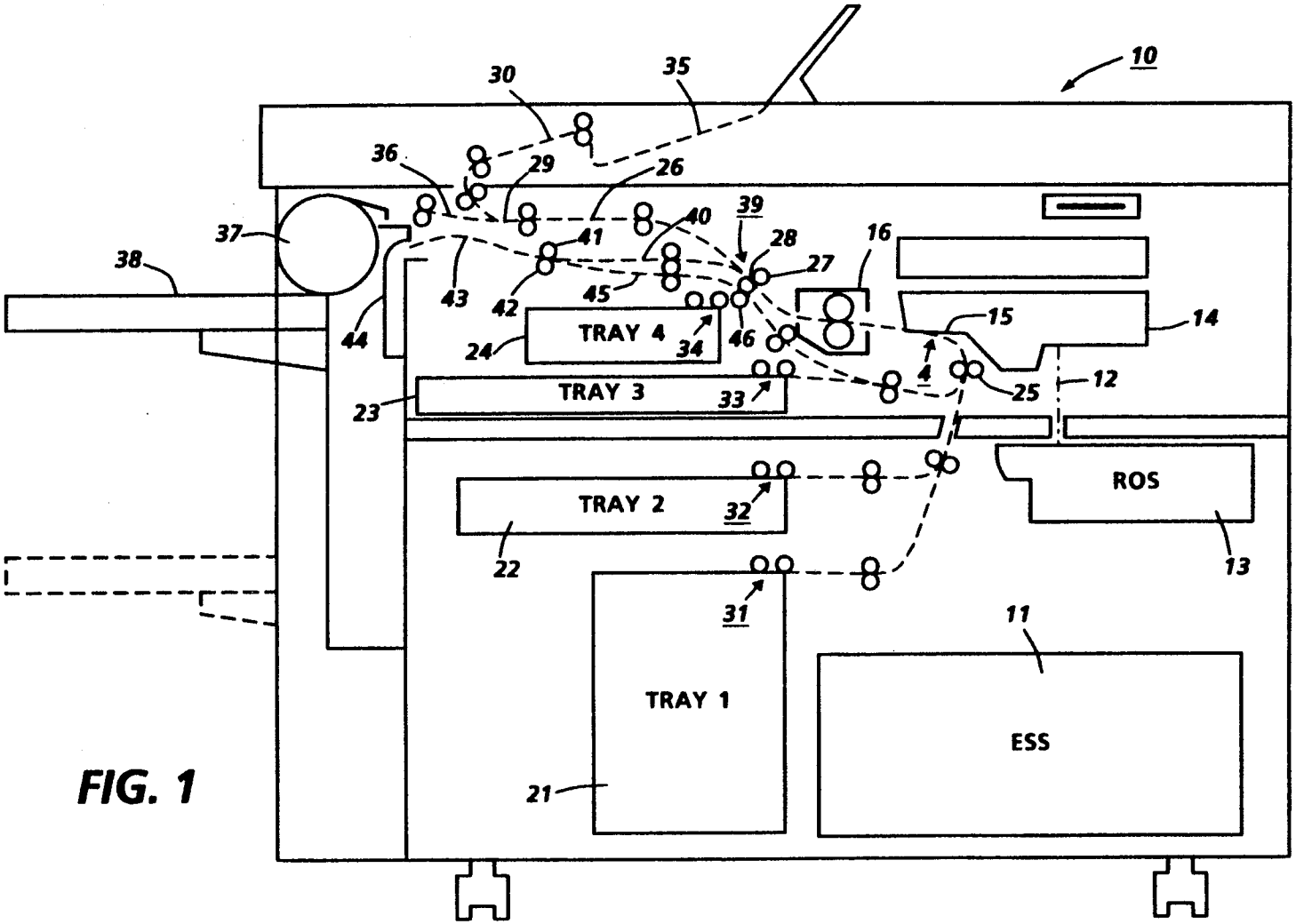

Cross-reference and incorporation by reference is made to commonly assigned copending U.S. Ser. No. 07/891,106 filed Jun. 1, 1992 now U.S. Pat. No. 5,219,159.

This invention relates to a sheet feeding apparatus and method which is particularly, although not exclusively, useful in a copier or printer such as a xerographic copier or printer. In copier and printers, it is necessary to register copy sheets both in the process direction and in a direction laterally of the process direction, to ensure correct placement of the image in each sheet. The present invention is concerned with the lateral registration of sheets in a sheet feeding apparatus.

A number of devices for lateral shifting and registration of sheets are known, such as the lateral sheet shifting or offsetting mechanisms of U.S. Pat. No. 4,712,786 and U.S. Pat. No. 4,480,825. In U.S. Pat. No. 4,712,786 a printing apparatus is disclosed that includes a sorter and an offsetting device. The offsetting device is positioned within the printer and is adapted to translate sheets en route to the sorter alternately front and rearward such that sheets are offset before they are driven into the sorter, with subsequent sheet sets being offset from each other within bins of the sorter. An apparatus for separating sets of copy sheets from a copier is disclosed in U.S. Pat. No. 4,480,825 that includes a mechanism that delivers alternate sets of sheets to a stationary tray along overlapping laterally spaced paths. Sheets are fed first through a transversely fixed assembly of opposing feed rollers and then through a second, transversely movable assembly of feed rollers into a stacking tray. Sheets belonging to alternate sets are offset by shifting the second set of rollers laterally.

U.S. Pat. No. 4,823,159 discloses a lateral shifting and registration arrangement in which the sheet is fed between two cooperating nip rollers which are stopped with the sheet still in the nip between them and shifted laterally until an edge of the sheet is detected by a sensor. The sheet is then registered laterally of the process direction and may be fed to the next stage in its process by rotation of the rollers. In this way, the sheet can be registered laterally while it is still held the nip in between the rollers. After each sheet has been fed out of the rollers, the roller assembly is shifted in the opposite lateral direction to the registration direction, back to a "home" position.

An arrangement of the kind described in U.S. Pat. No. 4,823,159 is especially useful in copying machines which make duplex, i.e. two-sided copies, and in which copy sheets carrying a first-side image are stopped, and then fed back in the opposite direction to receive an Image on their second side. Before being fed back, the sheet must be re-registered laterally of the process direction. Another device which re-registers copy sheets in these same circumstances is described in our U.S. Pat. No. 5,049,948, issued Sep. 17, 1991 to George Brown, et al., [EP-A-0 378 005] in which sheets passing through a sheet arrangement in a first, process, direction are not shifted laterally, but when stopped and reversed are shifted laterally so that they are driven towards an edge registration wall.

Also noted are U.S. Pat. No. 5,094,442, issued Mar. 10, 1992, filed Jul. 30, 1990 by David R. Kamprath et al., EK U.S. Pat. No. 4,805,892; U.S. Pat. No. 4,916,493; U.S. Pat. No. 4,799,084; and U.S. Pat. No. 4,058,359, especially the photodetectors for side shift control at Col. 5 and FIG. 3; and Fuji Xerox Japanese No. 3120-147A filed Mar. 10, 1989 as No. 258310.

There is still a need for an improved, inexpensive, accurate and reliable device for laterally registering sheets, especially in the situation described above where the sheet is stopped and reversed in a duplex copying or printing machine, but not necessarily limited thereto.

The present system is intended to meet this need, and accordingly discloses a sheet feeding apparatus including feeding means for feeding sheets in a process direction and registration means for registering each sheet in a direction laterally of the process direction, the registration means comprising shifting means for laterally shifting the feeding means, a sensor arranged to provide a signal on detecting the presence of a sheet, and control means to control the lateral shifting means in response to said signal, characterized in that the control means is operated such that if the sheet is not detected by the sensor on initial entry of the sheet into the feeding means the shifting means is activated to move the feeding means laterally towards the sensor until the sheet is detected by the sensor, whereupon said lateral movement is stopped, or, if the sheet is detected on Initial entry of the sheet into the feeding means the shifting means is first activated to move the feeding means laterally away from the sensor until the sensor no longer detects the sheet and is then activated to move the feeding means towards the sensor as aforesaid.

That is, if the sheet edge detection sensor is already occluded by the presence of a sheet extending beyond its edge detection range, then in this embodiment, the sheet is shifted transversely away from the sensor until its edge clears the sensor, then the sheet is reverse shifted laterally back to the (edge alignment) position at which the sensor is just occluded again. This also reduces hysteresis error in the edge registration, since the sheet is driven up to the sensor from the same direction in both situations (sheet entering with initial offset in either transverse direction). Only one sensor is required and desired.

The apparatus of the invention has the advantage that it can accommodate wide range of sheet positions as the sheet enters the device, on either side of a desired registration position. Whatever the initial sheet position, the device will always accurately register the sheet from the same direction, thereby eliminating any inconsistencies due to backlash or hysteresis in the system.

Figure 2:
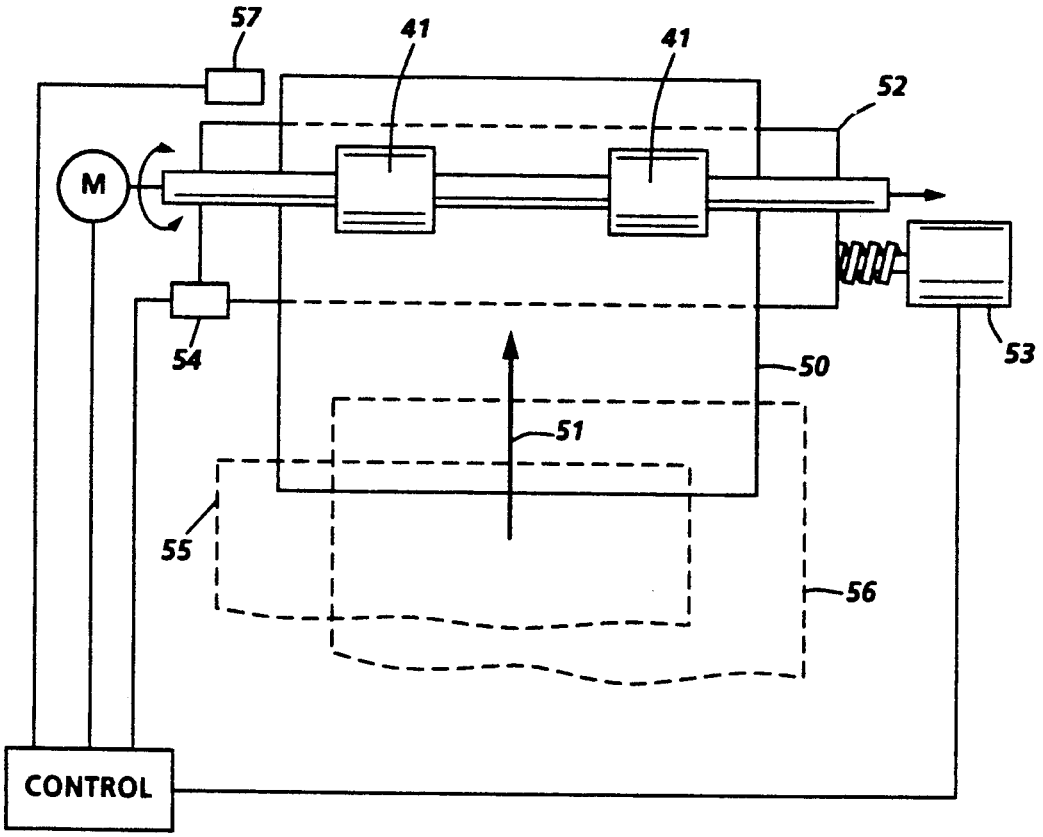

An exemplary apparatus in accordance with the invention will now be described, by way of one example, with reference to the accompanying drawings, in which:

FIG. 1 is schematic diagram showing the paper paths in a printer capable of making duplex copies and incorporating the sheet feeding apparatus of the invention; and FIG. 2 is a diagrammatic plan view of a sheet feeding apparatus according to the invention.

Referring to FIG. 1, the main elements of an exemplary xerographic laser printer 10 are shown in diagrammatic form. The printer produces prints, or copies, of input information in electronic form, typically derived from documents. Conventionally, the electronic input information, in digital form, is processed by an electronic sub-system (ESS) 11, and is used to modulate a scanning light beam 12, produced by a laser, in a raster output scanner (ROS) 13. The light beam 12, typically a laser beam, is directed onto a photoreceptor which is contained within a xerographic cassette 14. The photoreceptor is uniformly electrostatically charged and moved past a slit in the underside of the cassette 14. The beam 12 is scanned across the slit to form an electrostatic latent image on the photoreceptor by selectively discharging the uniform charge where light falls on it. The electrostatic latent image is developed with toner particles which adhere selectively to the latent image in the same configuration as the image, and the developed image is transferred, at transfer station 15, to a sheet of paper. The paper sheet, carrying the developed image, then passes through a fuser 16, consisting of a heated roller and a cooperating back-up roller, to fuse the image to the paper sheet, forming a permanent print or copy. The copy may then be transported into one of two output trays, as will be described in more detail below, or be returned, in a duplex imaging mode, to the xerographic cassette to receive a further developed image on its second side.

Paper sheets to receive the developed images are fed out of any one of four trays 21, 22, 23 and 24, with the different trays being capable of containing different sizes and different numbers of sheets. For example, tray 21 is a high capacity tray for containing the size of sheet most often used in the printer, for example A4 sheets. Trays 22 and 23 will accommodate larger sizes, and tray 24 may be used, for example, to contain special sheets such as coloured sheets or transparencies. Sheets are fed out of the trays 21, 22, 23 and 24 by respective sheet feeders 31, 32, 33 and 34, then by transport rollers through converging sheet paths until the sheet fed from any one of the four trays is feed by common fed roller pair 25 into the xerographic cassette 14 at transfer station 15. The sheet carrying the developed image then passes through fuser 16.

The further progress of a copy sheet through the machine depends on whether a simplex (one-sided) or duplex (two-sided) copy is being made. If a simplex copy is being made, the sheet follows upper paper path 26 after passing through transport rollers 27, 28. The sheet may then travel upwardly around sheet path 30, to be deposited in the top output tray 35, or it may proceed substantially horizontally along a path 36 to an inverter drum 37 before being deposited on the receiving tray of a high capacity stacker 38. A suitable sheet deflector is provided at point 29 so that the sheet passes along the chosen one of sheet paths 30 and 36.

In the case where a duplex copy is to be made, the sheet carrying its first-side image passes through transport rollers 27, 28 as before, but is deflected at point 39 along a lower sheet path 40 towards a pair of reversing rollers 41, 42. After a major portion of the sheet has been fed through reversing rollers 41, 42, along sheet path 43, and if necessary into vertical storage bin 44, the reversing rollers 41, 42 are stopped, and rotated in the opposite sense so as to refeed the sheet along a return paper path 45 from which it passes between transport rollers 28 and 46 to join the paper path normally followed by sheets initially fed from uppermost tray 24. The sheet then passes through common feed rollers 25 to receive a developed image on its other side at transfer station 15 of xerographic cassette 14. Thereafter, the duplex copy follows the upper paper path 26 as already described, with the option of feeding the sheet out into the top output tray 35, or the high capacity stacker 38.

Referring now to FIG. 2, there is shown a plan view of the reversing rollers 41 (with the cooperating rollers 42 beneath them, not visible in the figure). Rollers 41 or 42 are driven so that, in cooperating with each other, they drive a sheet 50 in the direction of arrow 51 until a major portion of the sheet has passed between the rollers. The rollers are then stopped, and the sheet registered laterally as will be described below. These rollers, in this example, are then reversed to drive the sheet back towards the xerographic cassette as described above, by a connecting conventional reversible motor M or clutch device.

Lateral registration of the sheet is achieved by movement of a carriage 52 which carries the rollers 41 and 42, the carriage being driven laterally of the process direction by a motor 53. Before each sheet of the paper is fed into the rollers 41, 42, the carriage is moved to a "home" position by motor 53, the home position being detected by a home position sensor 54. Thus, between the feeding of successive sheets, the carriage 52 is moved to the right if the home sensor 54 can see the carriage, or to the left if the sensor is clear. At the point that the sensor changes state, the motor 53 is stopped, and the carriage is in its home position.

A sheet of paper then enters the rollers 41, 42, and can be in any of a wide range of lateral position, as indicated by the extreme positions indicated in broken outlines at 55 and 56. Once the sheet has been fed through the reversing rollers 41, 42 to the correct extent, the rollers stop. If, at this point, a sheet edge sensor 57 cannot see the sheet, then the motor 53 is energized to move the carriage, and hence the rollers carrying the sheet, to the left. When the sensor 57 changes state, the motor is stopped, and the sheet is registered. If, however, the edge sensor 57 can already see the paper, then the motor 53 is first energized to move the carriage to the right until the sensor no longer sees the sheet, at which point the motor 53 is reversed and the carriage is now moved to the left. When the single edge sensor 57 changes state, again the motor is stopped, and the sheet is registered, (as was further previously described below).

In this way, any backlash in the system or hysteresis in the edge sensor 57 is also accounted for. Once the sheet is registered, it is ready to be fed back to the transfer station.

The registration system of the invention provides an accurate, reliable, and inexpensive way of registering sheets, whether in a reversing roller arrangement, as described, or in any other situation where a sheet needs to be registered laterally of its process direction. The approaching sheet can be positioned over a wide range of lateral positions, such that the edge of the sheet may or may not be sensed initially by the edge sensor 57. This arrangement is also very economical of space within the machine.

What is claimed is:

1. Sheet feeding apparatus including sheet feeding means for feeding sheets in a process direction, and registration means for registering the sheet in a direction laterally of the process direction; said registration means comprising shifting means for laterally shifting said feeding means a fixed sheet edge sensor providing a control signal on detecting the presence of a sheet in said sheet edge sensor, and control means to control said lateral shifting means in response to said sheet edge detection control signal, characterized in that:

if a sheet is not detected by said edge sensor upon the entry of the sheet into said feeding means, then said lateral shifting means is activated to move said feeding means laterally towards said sensor until the sheet is detected by said sensor, whereupon said lateral movement is stopped;

but if the sheet is already detected by said same sensor upon the entry of the sheet into the feeding means, then the shifting means is first activated to move the feeding means laterally away from said sensor until said sensor no longer detects the sheet, and then said shifting means is automatically reverse activated to move said feeding means back towards said same sensor until the sheet is again detected by said same sensor, being approached from the same direction, to reduce hysteresis error, whereupon said lateral movement Is stopped.

2. The apparatus of claim 1, further including means for driving said sheet feeding means to drive a sheet in a first direction, stopping the sheet in said sheet feeding means to enable said registration means to register the sheet, and then reversing said feeding means to drive the sheet in a direction opposite the first direction.

3. The apparatus of claim 1, wherein said sheet feeding means comprises at least one pair of rollers mounted on a carriage, said lateral shifting means being connected to said carriage.

4. In a method of sheet feeding and lateral registration, including feeding sheets in a process direction with a sheet feeder, and registering the sheet in a direction laterally of the process direction; said lateral registration comprising laterally shifting said sheet feeder by sensing a sheet edge at a sensing position and controlling this lateral shifting movement in response to said sheet edge sensing, characterized in that:

if the sheet is not initially sensed at said edge sensing position, then said lateral shifting is activated to move said sheet feeder laterally towards said sensing position until the sheet is sensed, whereupon said lateral shifting movement is stopped;

but if the sheet is already initially sensed in said sensing position, then the sheet is first shifted laterally away from said sensing position until it is no longer sensed, and then said sheet is automatically reverse shifted laterally to move back towards said same sensing position until the sheet is again sensed approaching from the same direction, to reduce hysteresis error, whereupon said lateral shifting movement is stopped.

5. The method of claim 4, further including driving the sheet in a first process movement direction with the sheet feeder, stopping the sheet in the sheet feeder to enable said sheet lateral registration, and then reversing the sheet feeder to drive the sheet in a direction substantially opposite said first direction.

* * * * *